United States Patent [19]

Podsobinski

[11] Patent Number: 4,844,176

[45] Date of Patent: Jul. 4, 1989

[54] AIR TOOL WITH TORQUE SHUT-OFF VALVE

[75] Inventor: Paul A. Podsobinski, Willowick, Ohio

[73] Assignee: The Rotor Tool Company, Cleveland, Ohio

[21] Appl. No.: 1,350

[22] Filed: Jan. 8, 1987

[51] Int. Cl.[4] ..... B25B 23/14

[52] U.S. Cl. ..... 173/12; 91/59; 137/505.13

[58] Field of Search ..... 173/12, 169, 170; 91/59; 137/505, 505.13

[56] References Cited

U.S. PATENT DOCUMENTS

| | | | |
|---|---|---|---|
| 3,608,131 | 9/1971 | Hornschuch et al. | 173/12 |
| 3,791,458 | 2/1974 | Wallace | 173/12 |
| 3,821,991 | 7/1974 | Alexander | 173/12 |
| 4,243,111 | 1/1981 | Willoughby et al. | 91/59 X |
| 4,434,858 | 3/1984 | Whitehouse | 173/12 |
| 4,492,146 | 1/1985 | Workman, Jr. | 173/12 |

*Primary Examiner*—Frank T. Yost
*Assistant Examiner*—James L. Wolfe
*Attorney, Agent, or Firm*—Calfee, Halter & Griswold

[57] ABSTRACT

The air tool of the present invention includes a torque shut-off valve totally enclosed within and substantially coaxial with the body housing of the tool. The torque shut-off valve includes a valve member reciprocally sliding in and guided by a bore and counterbore in the valve body. The valve member is biased by a reset spring to its open position before the tool cycle is initiated. In operation, the valve member is axially biased toward its open position by supply line air pressure in an air inlet chamber in conjunction with controlled reduced air pressure in an associated compartment and is axially biased toward the closed position by motor inlet pressure. A preselected motor back pressure resulting from achieving the desired tool torque operates to overcome the opposing pressure to close the valve member to block air flow to the motor.

16 Claims, 2 Drawing Sheets

AIR TOOL WITH TORQUE SHUT-OFF VALVE

FIELD OF THE INVENTION

The present invention generally relates to an air tool having a torque shut-off valve and specifically relates to a torque shut-off valve of simplified construction that can be coaxially inserted in and contained within the tool body housing.

BACKGROUND OF THE INVENTION

Air tools are often used to apply torque to a work piece. For example, a nutrunner air tool may be used to provide relative rotation between a nut and bolt to run the nut along the bolt to make a threaded connection. The torque applied substantially increases under load when the threaded connection approaches being fully installed. Torque shut-off valves have been developed for use in such air tools automatically to shut off the air supply to the motor when a preselected torque level is achieved.

For example, Whitehouse U.S. Pat. No. 3,373,824 discloses a spool type torque shut-off valve extending across the tool body with its ends protruding therefrom. This spool valve was normally held open by an adjustable coil spring acting against a first side of the spool valve. The spool valve could be closed when the motor back pressure operating on the second opposed side of the spool valve exceeded the selected spring pressure when preselected motor torque levels were reached. The torque shut-off valve in U.S. Pat. No. 3,373,824 would not close if the selected spring pressure was not exceeded. This would result in a low torque condition. This failure to close could result, for example, when additional tools were being operated on a common air system reducing the line pressure of the air supplied to the tool. In addition, the air tool with torque shut-off shown in U.S. Pat. No. 3,373,824 was ergonomically disadvantageous because of the valve ends projecting out of both sides of the tool, created wiring problems on instrumented models because the valve extended normal to the longitudinal axis of the tool and was subject to valve wear because the main air flow through the shut-off valve created side load forces on the spool valve body.

To overcome the failure to close when low torque had been achieved in reduced line pressure situations, torque shut-off valves were developed for air tools wherein controlled line pressure on one side of the spool valve acted against air pressure at the motor on the other side of the spool valve. Two variations of comparing controlled air line pressure to motor air pressure as shown in Whitehouse U.S. Pat. No. 4,434,858 (comparing controlled line pressure to motor back pressure) and Willoughby U.S. Pat. No. 4,243,111 (comparing controlled air line pressure to motor exhaust pressure). The shut-off valves in U.S. Pat. Nos. 4,434,858 and 4,243,111 solved the problem of the failure to close when the motor back pressure did not exceed the preselected spring pressure but failed to solve the other problems present in the tool disclosed in U.S. Pat. No. 3,373,828. Specifically, the Whitehouse '858 and Willoughby patents disclose shut-off valves positioned across the tool and extending outwardly from the tool profile to create ergonometric and wiring problems. These shut-off valves are also prone to potential wear problems because the main air passage side loads the slidable spool valve. Finally, these valves have external vents for the bias air, and oil can pass through the external vents and accumulate on the tool handle.

SUMMARY OF THE INVENTION

The principal object of the present invention is to overcome the problems in the prior art by providing a torque shut-off valve totally contained within and coaxial with the body housing of the tool. By coaxially mounting the torque shut-off valve body, the outer tool profile remains substantially unchanged. In instrumented tool models, the wiring may readily be longitudinally accomodated in the tool housing or between the tool housing and exhaust deflector.

It is another object of the present invention to provide a valve member movable between an open and closed position relative to the air supply passage to the motor wherein the valve member is only subjected to axially applied air pressure loading. By exclusively axially loading the valve member, the life of the torque shut-off valve is enhanced, and the torque shut-off valve is subject to fewer manufacturing and maintenance problems.

It is yet another object of the present invention to provide an adjustable torque shut-off valve which is normally totally enclosed within the tool profile but which is readily accessible for adjustment if desired. By enclosing the valve within the tool profile, the ergonomics of tool use are improved and inadvertent or undesired adjustments of the torque shut-off valve are minimized. In addition, oil is contained in the tool and cannot accumulate on the tool handle.

It is still another object of the present invention to provide a torque shut-off valve of simplified construction that can be readily inserted into the body housing. The porting for the torque shut-off valve is formed in a single valve body which is then inserted into the body housing.

These and other objects and advantages of the present invention will become apparent as the following description proceeds.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DETAILED DESCRIPTION OF THE PREFERRED EMBODIMENT

Figure 1:
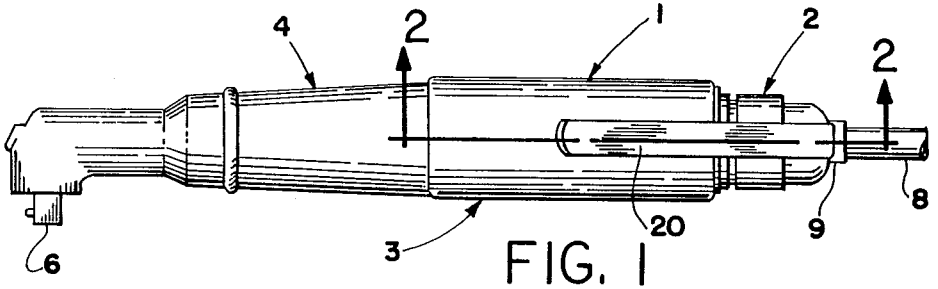
FIG. 1 is a side elevation of an angle nutrunner air tool, which is an exemplary air tool employing the torque shut-off valve of the present invention.

Turning now in more detail to the drawings and initially to FIG. 1, an angle nutrunner, indicated generally at 1, includes a handle portion 2, an air motor portion 3, a speed reduction portion 4 and a work output portion 5. The work output portion 5 may include a drive spindle 6 or a conventional flush socket, not shown. This drive spindle or drive socket is rotated to complete a threaded connection when the tool 1 is actuated by an operator grasping the handle section 2 and selectively actuating air flow to the tool.

Compressed air, for example from the factory air system, can be supplied to the tool 1 by a system hose 8 being connected to inlet coupling 9 in the rear of handle 2. The compressed air passes through filter screen 10 into inlet passage 11. The compressed air in inlet passage 11 may selectively pass into main air supply line 12 by manual actuation of a conventional throttle valve, indicated generally at 14.

The throttle valve 14 includes a plunger 15 normally biased upwardly by spring 16 to a position in which the O-ring seal 17 engages valve seat 18. With seal 17 seated in its closed position, compressed air in inlet passage 11 is blocked from flowing into main supply line 12. A lever 20 is pivotally mounted as shown at 21 to the back of handle 2, with the lever resting on the top end of plunger 15. When the lever is manually depressed, the plunger 15 is driven downwardly against the spring bias to unseat seal 17 and to allow air to flow past the throttle valve into main supply line 12. When the lever 20 is released, spring 16 will move the plunger and lever upwardly to reposition seal 17 on seat 18 to block the flow of compressed air into main air supply line 12.

Figure 2:
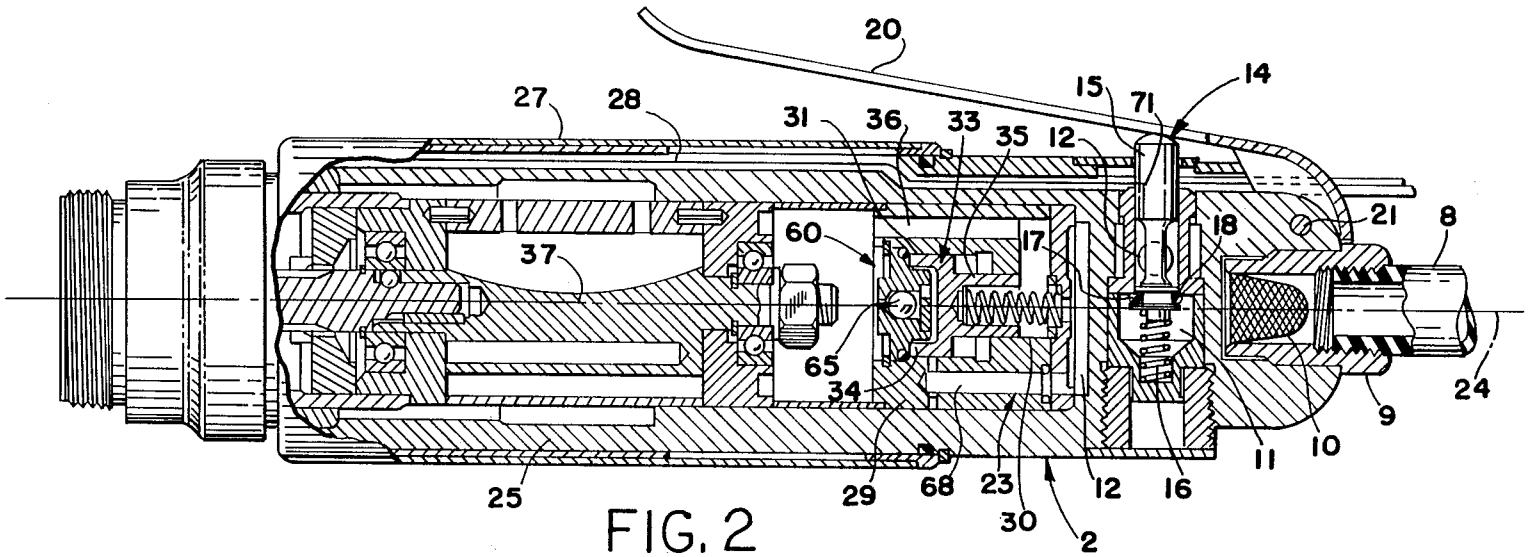
FIG. 2 is a cross section of the handle and motor portion of the tool incorporating the torque shut-off valve, taken generally along the plane 2—2 in FIG. 1.
Figure 3:
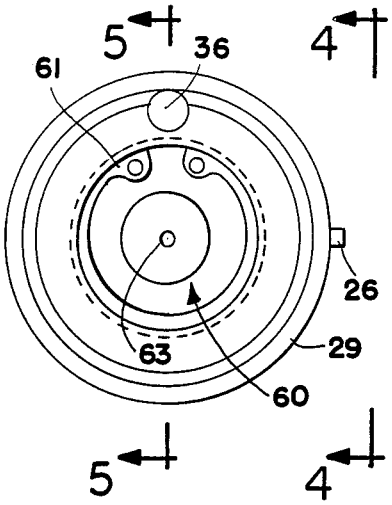
FIG. 3 is a down stream end view of the shut-off valve of the present invention.

The compressed air selectively flowing through main supply line 12 enters a torque shut-off valve, indicated generally at 23. The torque shut-off valve is coaxial with the longitudinal axis 24 of the nutrunner 1 and is totally contained within the body housing 25. The torque shut-off valve is positioned within body housing 25 by locator pin 26. In instrumented models, an exhaust deflector 27 encloses and is radially spaced from the body housing 25 to provide an uninterrupted clearance for wiring and ducting, with the wiring being illustrated at 28 in FIG. 2.

The torque shut-off valve 23 includes a generally cylindrical body 29, preferably of aluminum, formed with bore 30 and counterbore 31. The bore and counterbore cooperatively define at their intersection a radially extending annular shoulder 32. A valve member 33 is received within and reciprocates along the bore 30 and counterbore 31.

The valve member 33 includes a cup shape portion 34 and an integrally formed annular skirt 35 of reduced diameter. The annular skirt 35 extends upstream from the cup shape portion 34.

The outer wall of the cup shape portion 34 is slidingly received in and guided by the internal diameter of counterbore 31. The outer diameter of valve skirt 35 is slidingly received in and guided by the inner diameter of bore 30. The valve member 33 is free to slide in and is guided by the bore 30 and counterbore 31 between its open position shown in FIG. 5 and its closed position shown in FIG. 6.

Figure 5:
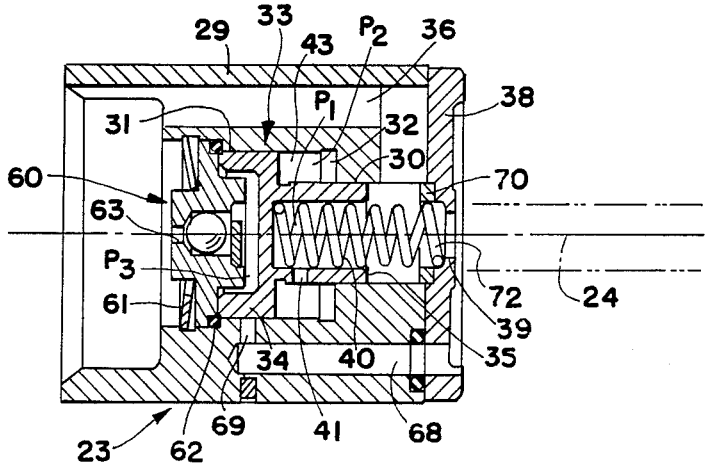
FIG. 5 is a cross section of the torque shut-off valve taken along the plane 5—5 in FIG. 3 showing the valve member in its open position providing air flow to the motor.
Figure 6:
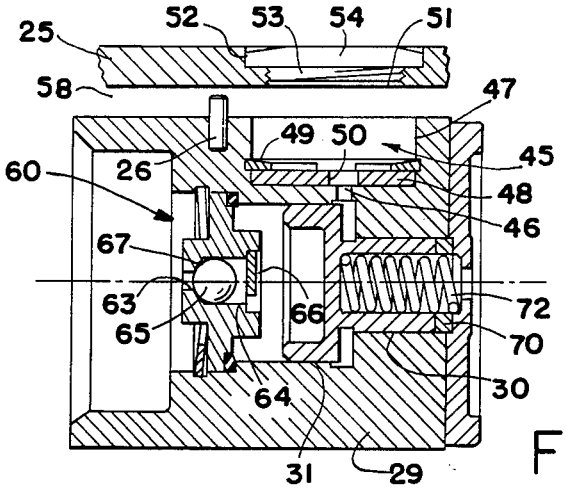
FIG. 6 is a cross section of the torque shut-off valve taken along plane 6—6 in FIG. 4 showing the valve member in its closed position and further showing the air bleed passage leading to the tool exhaust passage.

In the open position shown in FIG. 5, the skirt 35 uncovers motor inlet passage 36 leading downstream to air motor 37. The motor inlet passage 36 is drilled in body 29 of the torque shut-off valve and bypasses the counterbore 31 by extending from bore 30 radially around counterbore 31.

The upstream end of torque shut-off valve body 29 is closed by plate 38. Plate 38 has a central air opening 39 coaxial with the longitudinal axis 24 of the tool 1. Compressed air from main supply line 12 enters the torque shut-off valve 23 by passing through central opening 39 into inlet chamber 40 within skirt 35 and into motor inlet passage 36 when the valve member 33 is open.

The compressed air in inlet chamber 40 bears against the part of cup shape portion 34 of valve 33 that is contained within the skirt 35. This substantially full line air pressure P1 against the limited surface area of the cup shape portion 34 of valve 33 urges the valve member 33 to the left as viewed in FIG. 5 toward it open position. In addition, the compressed air in inlet chamber 40 passes between the skirt 35 and bore 30 and also passes through small diameter inlet orifice 41 in skirt 35 into a reduced pressure compartment 43. The pressurized air P2 in reduced pressure compartment 43 acts against the upstream side of cup shape portion 34 radially outside the annular skirt 35 to assist in biasing the valve member 33 to the left as viewed in FIG. 5 toward its open position.

The reduced pressure compartment 43 is cooperatively defined by counterbore 31, shoulder 32, skirt 35 and cup shape portion 34. The pressure P2 within the reduced pressure compartment 43 can be selectively controlled by an adjustable air bleed control mechanism indicated generally at 45.

The air bleed control mechanism 45 includes an air bleed passage 46 communicating with the upstream end of reduced air pressure compartment 43. At its other end, the air bleed passage 46 communicates with an enlarged diameter opening 47 in valve body 29. An adjustable control plate 48 is rotatably mounted in the end of enlarged diameter opening 47. The adjustable control plate 48 is removably held in position by a snap ring 49 received in an annular groove in the inner diameter of opening 47. The control plate 48 has a hole 50 therein cooperating with bleed passage 46 selectively variably to control the amount of air flowing therethrough upon adjustment of control plate 48.

To provide access for adjusting control plate 48, a threaded access aperture 51 is provided in body housing 25. The threaded access aperture 51 includes a radially outer counter bore section 52. The access aperture 51 is normally closed by a threaded plug 53, with the head 54 of the threaded plug being received in counter bore 52 to provide a flush exterior surface for the tool. The plug 51 is thus ergonomically and aesthetically beneficial by providing a smooth exterior profile for the tool. The plug 51 also precludes inadvertant adjustment of air bleed control mechanism 45.

Figure 4:
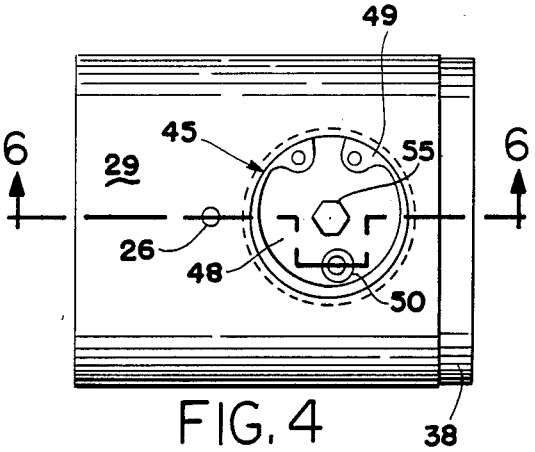
FIG. 4 is a side view of the shut-off valve of FIG. 3 illustrating the adjustable control plate for varying the effective size of the air bleed passage.

When the plug 53 is removed, a wrench may be inserted therethrough to engage a hexagonal opening 55 formed in adjustable control plate 48. When the hexagonal opening 55 is rotated, the adjustable plate 48 also rotates. The rotation of control plate 48 results in the hole 50 moving across bleed passage 46 progressively to have different positions relative to the bleed passage 46. By selectively rotating adjustable plate 48, the effective size of the bleed passage 46 may progressively be varied from the fully open position as shown in FIG. 4 to a fully closed position. The snap ring 49 frictionally holds the control plate 48 in the position selected.

By selectively varying the effective size of the air passage 46, the amount of pressurized air flowing therethrough can be controlled to regulate the pressure in reduced air pressure compartment 43 to the level required for the specific tool application. The air passing through air bleed passage 46 into enlarged diameter section 47 enters the tool exhaust passage 58 formed in the body housing 25. As shown, the locator pin 26 is received in the exhaust passage 58 properly to position the torque shut-off valve 23 relative to the body housing 25. By bleeding to the tool exhaust passage 58 with some air pressure therein, potential air pressure spikes in tool start up can be reduced. In addition, all oil is contained within the tool to enhance its use and to improve its appearance.

The pressure P1 in chamber 40 and the reduced pressure P2 in compartment 43 urge the valve 33 to its open position. The cumulative pressure of P1 and P2 is opposed by the air pressure P3 at the inlet to motor 37. In the free running mode of the nutrunner tool, air passing through motor inlet passage 36 experiences a pressure drop thereacross resulting in P3 being less than P1. The compressed air at pressure P3 axially acts against the downstream side of cup shape portion 34 of valve member 33 by passing through a check valve assembly indicated generally at 60. In the free running mode of the tool, the force created by P3 acting on the entire downstream side of valve 33 is less than the cumulative force created by P1 acting on the area inside skirt 35 and P2 acting on the area outside start 35, thereby to hold valve member 33 in its open position.

The check valve assembly 60 is mounted in counterbore 31 by retaining ring 61 and is sealed to the internal diameter of counterbore 31 by O-ring seal 62. The check valve assembly 60 includes a first bore 63 and a second enlarged, coaxial bore 64. A ball 65 is received in enlarged bore 64 and is retained therein by a stop 66. The ball 65 floats within the second bore 64 with its position therein being determined by the relative air pressure on opposite sides of the ball. A seat 67 is provided between first and second bores 63 and 64, respectively, and the ball 65 when urged against seat 67 closes off first bore 63.

As the torque on motor 37 increases, the motor back pressure P3 at the entrance to motor 37 increases as progressively less air goes through motor 37. This increased pressure P3 keeps the ball 65 off its seat 67 allowing compressed air to pass therethrough against the downstream end of cup shape member 34 on valve member 33. When the torque reaches the preselected cut off level, the force created by pressure P3 acting on the downstream side of the cup shape member 34 will be greater than the cumulative force created by pressures P1 and P2 acting on the upstream side of cup shape portion 34. The force created by pressure P3 will then begin to drive the valve member 33 to the right as viewed in FIGS. 5 and 6 toward its closed position. This movement toward closure is enhanced by a hold down passage 68 in torque shut-off valve body 29.

As best shown in FIG. 5, the hold down passage 68 in valve body 29 communicates with a right angle inlet 69 into the internal diameter of counterbore 31. The hold down inlet 69 is normally blocked by the cup shape portion 34 when the valve member 33 is in its open position. However, as the valve member 33 moves to the right when the force created by P3 is greater than the cumulative force created by P1 and P2, the hold down inlet 69 is opened to introduce compressed air at substantially system pressure to the left or downstream side of cup shape member 34. This system pressure acting against the entire downstream face of cup shape portion 34 drives the valve member 33 to its closed position. The ball 65 is returned to the left by the system pressure to urge the ball against seat 67 to close the check valve assembly 60 to keep the system air from entering the motor.

When the valve member 33 is closed, the upstream end of annular skirt 35 engages annular seal 70 mounted on plate 38. In such position, the annular skirt 35 of valve member 33 extends across the motor inlet passage 36 to block passage of air to the motor 37. The valve member 33 remains in its closed position blocking air flow to the motor as long the throttle valve is open allowing system air to pass through hold down passage 68 and inlet 69 against the downstream end of cup shape portion 34.

When the lever 20 is deactuated to close throttle valve 14, the system air on the downstream side of cup shape portion 34 of valve 33 can bleed from the tool in two ways. First, some of the captured air can bleed past valve member 33 through bleed control mechanism 45. Second, the captured air can bleed back through inlet 69 and hold down passage 68 and then through throttle valve 14 to atmosphere. The plunger 15 has a flat 71 thereon that allows air to pass therethrough to atmosphere when the throttle valve is in its closed position.

When the captured compressed air has bled to atmosphere, the reset spring 72 returns the valve member 32 to its open position. The reset spring 72 extends between the plate 38 and the cup shape member 33 of valve 32.

As is apparent from the above, the torque shut-off valve 23 principally consists of a single valve body 29 ported to provide a simplified valve construction. This valve body and associated plate 38 are totally contained within the coaxial with the body housing 25. By so orienting the torque shut-off valve, a smooth tool exterior profile is obtained, and, in instrumented tool models, an uninterrupted wiring clearance is provided between the motor housing and the exhaust deflector. Moreover, valve member 33 is only subjected to axially oriented air pressure forces P1, P2 and P3 to enhance valve life and operation.

It will be apparent from the foregoing that charges may be made in the details of construction and configuration without department from the spirit of the invention as defined in the following claims.

I claim:

1. An air tool comprising a body housing, an air motor in the body housing, work output means driven by the air motor, a main air supply line in the tool selectively to direct pressurized air to the air motor to drive the same, and a torque shut-off valve contained totally within the body housing and positioned in the air supply line upstream of the air motor to shut off delivery of air to the motor when the torque generated by the work output means reaches a preselected level, said torque shut-off valve including (a) a valve body having a bore and counterbore, with the bore partially defining an air inlet chamber coupled to the air supply line, (b) a valve member reciprocally slidable in said bore and counterbore between open and closed positions having a skirt portion thereof cooperating with the counterbore to define a reduced pressure air compartment communicating with the air inlet chamber, (c) air bleed control means for the reduced pressure air compartment selectively to control the air pressure therein, the pressurized air in the air inlet chamber and in the reduced pressure air compartment cooperatively acting against a first upstream side of the valve member to bias it toward the open position, and (d) a motor air supply passage in the valve body leading from the air inlet chamber around the counterbore to a motor inlet section to direct pressurized air to the motor when the valve member is in its open position, the pressurized air in the motor inlet section selectively communicating with an axially opposed, second downstream side of the valve member to bias it toward a closed position blocking the motor air supply passage, with the force created by the air pressure in the motor inlet section at the preselected tool torque level exceeding the cumulative force created by air pressure in the air inlet chamber and in the reduced pressure air compartment to close the valve member.

2. The air tool of claim 1 wherein a check valve is positioned in the counterbore downstream of the valve member to allow pressurized air from the motor inlet section to pass therethrough against the axially opposed, second downstream side of the valve before the tool reaches its preselected torque and to block air flow therethrough after the tool reaches its preselected torque.

3. The air tool of claim 2 wherein the valve member has a cup shape portion integrally formed with and of larger diameter than the skirt portion, with the outer diameter of the cup shape portion sliding along and being guided by the inner diameter of the counterbore.

4. The air tool of claim 3 wherein the valve skirt portion has an orifice therethrough to allow air to pass from the inlet chamber to the reduced pressure compartment.

5. The air tool of claim 4 wherein the counterbore is annular and has an annular shoulder at its upstream end and part of the outer diameter of the skirt portion of the valve member slides along the inner diameter of the bore and is guided thereby during valve member movement.

6. The air tool of claim 5 wherein the valve body has a hold down passage extending between the air supply line and the inner diameter of the counterbore upstream of the check valve, the hold down passage being blocked by the cup shape portion of the valve member when in its open position and being open when the valve member is approaching or in its closed position, whereby air supply line pressure passes through the hold down passage and against the second side of the valve member after the preselected torque has been reached to retain the valve member in its closed position until tool operation is discontinued.

7. The air tool of claim 6 further comprising an exhaust deflector extending around and being radially spaced from the body housing to provide a clearance for wiring or the like in an instrumented tool.

8. The air tool of claim 6 further comprising a reset spring extending between the valve body and valve member automatically to return the valve member to its open position when a tool cycle has been completed and the hold down air bled from the tool.

9. The air tool of claim 1 or claim 6 wherein the body housing has an air exhaust passage formed therein and the controlled bleed passage leads from the reduced pressure air compartment to the air exhaust passage.

10. The air tool of claim 9 wherein the bleed passage has an enlarged diameter section receiving an adjustable control plate selectively to vary the opening size in the bleed passage to control the amount of pressurized air escaping from the reduced pressure air compartment.

11. The air tool of claim 10 wherein the body housing has a normally covered opening therein aligned with the enlarged diameter section of the bleed passage, the opening when uncovered providing access to the control plate for selective adjustment.

12. The air tool of claim 11 further comprising a threaded aperture in the body housing in alignment with the bleed passage and a threaded plug received in and sealed to the aperture, said plug being selectively removable to provide access to the control plate for adjustment.

13. The air tool of claim 1 wherein the valve member, valve body and body housing are all coaxial along the longitudinal axis of the air tool.

14. An air tool comprising a body housing, an air motor in the body housing, an air line in the body housing selectively to supply compressed inlet air to the motor and a torque shut-off valve coaxially contained totally within the body housing in the air line upstream of the air motor, the torque shut-off valve comprising (a) a valve body having a bore and counterbore along its longitudinal axis and having an air inlet passage to the motor extending from the bore radially around the counterbore, (b) a valve member having opposed upstream and downstream sides reciprocally slidable in the bore and counterbore between an open position allowing air to pass from the bore through the air inlet passage to the motor and a closed position blocking flow through the air inlet passage when the tool has reached a preselected torque, and (c) air pressure control means for controlling pressure of the inlet air acting on the upstream side of the valve member, the valve member only being subjected to axially applied air pressure loads with the controlled pressure inlet air acting on the upstream side of the valve member and the motor back pressure acting on the downstream side of the valve member.

15. The air tool of claim 14 wherein the valve member includes an enlarged diameter portion sliding along and guided by the counterbore and a reduced diameter skirt portion sliding along and guided by the bore, with the valve member cooperating with the counterbore to define a reduced pressure air compartment forming part of the air pressure control means.

16. The air tool of claim 15 wherein the air pressure control means further includes an orifice in the skirt portion to allow compressed air to pass from the bore to the reduced pressure air compartment and an air bleed control mechanism to control the air pressure in the reduced pressure air compartment by controlled air bleeding from the reduced pressure air compartment to an exhaust passage in the body housing.

* * * * *